US005606948A

United States Patent [19]

Gonnering

[11] Patent Number: 5,606,948

[45] Date of Patent: Mar. 4, 1997

[54] SPEED GOVERNING METHOD AND APPARATUS FOR AN INTERNAL COMBUSTION ENGINE

[75] Inventor: John B. Gonnering, West Bend, Wis.

[73] Assignee: Briggs & Stratton Corporation, Wauwatosa, Wis.

[21] Appl. No.: 607,825

[22] Filed: Feb. 27, 1996

[51] Int. Cl.[6] ..... F02D 31/00

[52] U.S. Cl. ..... 123/352; 364/426.041

[58] Field of Search ..... 123/352, 350, 123/351; 364/426.04, 431.07; 180/197, 176, 177, 170, 179, 178

[56] References Cited

U.S. PATENT DOCUMENTS

| | | | |
|---|---|---|---|
| 3,034,028 | 5/1962 | Jamieson | 123/352 |
| 4,359,125 | 11/1982 | Shinoda et al. | 180/179 |
| 4,453,517 | 6/1984 | Kasiewicz | 123/352 |
| 4,508,078 | 4/1985 | Takeuchi et al. | 123/399 |
| 4,707,792 | 11/1987 | Naitou | 360/431.07 |
| 4,823,749 | 4/1989 | Eisenmann et al. | 123/339 |
| 4,833,612 | 5/1989 | Okuno et al. | 364/426.04 |
| 5,003,948 | 4/1991 | Churchill et al. | 123/352 |
| 5,016,588 | 5/1991 | Pagdin et al. | 123/399 |
| 5,138,996 | 8/1992 | Fiorenza, II | 123/335 |
| 5,253,626 | 10/1993 | Hatano et al. | 123/352 |
| 5,279,271 | 1/1994 | Hofsaess et al. | 123/350 |
| 5,287,835 | 2/1994 | Fiorenza, II et al. | 123/352 |
| 5,337,237 | 8/1994 | Katayama et al. | 364/426.04 |
| 5,392,215 | 2/1995 | Morita | 364/426.04 |
| 5,400,756 | 3/1995 | Mentgen | 123/399 |
| 5,508,925 | 4/1996 | Katayama et al. | 364/426.04 |

*Primary Examiner*—Raymond A. Nelli
*Attorney, Agent, or Firm*—Michael, Best & Friedrich

[57] ABSTRACT

The engine governor outputs a pulse width modulated actuator control signal at two or more frequencies to improve actuator performance. In one embodiment, the control signal has a frequency of about 60 to 70 hertz when the throttle is nearly closed, and switches to a frequency of between 5 to 30 hertz once the throttle is between 50 to 75 percent open. In a second embodiment, the frequency of the actuator control signal decreases in a linear manner from 60 to 70 hertz to between 5 to 30 hertz as the throttle is opened from a closed throttle position to wide open throttle. A decrease in frequency with increased throttle opening provides additional control signal off time, thereby allowing the magnetic field in the actuator to sufficiently dissipate for proper dithering action.

20 Claims, 4 Drawing Sheets

SPEED GOVERNING METHOD AND APPARATUS FOR AN INTERNAL COMBUSTION ENGINE

BACKGROUND OF THE INVENTION

This invention relates to electronic speed governors for internal combustion engines. More particularly, this invention relates to such speed governors that use an electromagnetic actuator responsive to a drive control signal.

Several types of electronic governors are well-known in the art. In a typical electronic governor, a control signal is output by a microprocessor to an electromagnetic actuator, which in turn is interconnected with the engine throttle. The control signal is pulse width modulated, with the duty cycle being a function of the desired throttle opening. The actuator force applied to the throttle is opposed by a spring force of a return spring, which tends to bias the throttle closed at larger throttle openings. The actuator force is also opposed by frictional forces of the system, and other forces resulting from the off-center arrangement of the throttle valve. An off-center throttle also tends to bias the throttle to the closed position at larger throttle openings. The control signal typically has a fixed frequency.

A problem with the prior art electronic governor occurs when the inductance in the actuator become sufficiently large to create a 50 percent or greater duty cycle. This corresponds to approximately fifty percent throttle valve opening. At this level, the actuator inductance becomes sufficiently large so that it is difficult to make relatively small adjustments in the throttle plate opening and thus in engine speed. Small adjustments are desirable so that the operator does not audibly notice changes in the engine speed. These small changes are on the order of 10 to 15 rpm.

When the inductance reaches this level, and at a control signal frequency of 60 hertz or greater, the OFF time of the control signal is not long enough to enable the actuator's magnetic field to collapse. As a result, current is still flowing in the actuator coil, and the actuator rotor prevents the throttle valve connected thereto from moving in the closing direction before the next ON time of the control signal. That is, the system does not have time to react before the next positive pulse is received. As a result, the throttle valve and the actuator tend to stay in the same position in which they previously were positioned, until the actuator force becomes sufficiently large to move the throttle valve. This is undesirable, however, because a significant speed change will then occur instead of a small speed change, which will be clearly audible to the operator. The resulting speed may actually be outside of the specified speed band. In addition, this prior art system also causes undesirable speed hunting or speed oscillations.

One way to solve this problem would be to reduce the friction in the actuator by, for example, using ball bearings. This solution is unsatisfactory, however, because it substantially increases the cost of the actuator.

A second possible solution would be to reduce the inductance of the actuator. However, the actuator current must be correspondingly increased to yield the same actuator force. This solution is undesirable, however, because the use of higher current increases the heat output of the actuator coil, and requires higher temperature wiring between the control unit and the actuator.

SUMMARY OF THE INVENTION

An electronic speed governor is disclosed which controls the opening and closing of an engine throttle to keep the engine speed near a reference speed, while at the same time permitting small changes in engine speed to take place without undesirable changes in audible engine noise. At the same time, the electronic governor precisely controls the engine speed within a selected speed band without undesirable speed oscillations or hunting.

The speed governor according to the present invention includes an electromagnetic actuator that is interconnected with an engine throttle valve via a linkage. The speed governor also includes a means for determining the speed of the engine and for storing an engine speed value that is representative of the engine speed. The speed may be determined, for example, by starting a counter as soon as an ignition event occurs, and stopping the counter when the next ignition event occurs, there being a single ignition event per engine revolution. The speed may also be determined in other ways, such as by using a Hall effect sensor to sense a magnet affixed to the engine flywheel.

The electronic governor also includes a means for storing a reference speed value that is functionally related to a desired or reference speed. A storing means also stores an actual position value that is functionally related to the actual or current position of the throttle. A comparison means compares the engine speed value with the reference value, and generates an error value if the engine speed value differs from the reference speed value by more than a preset value. The preset value may be used to determine an acceptable speed band around the reference speed value, in which the actual engine speed is allowed to vary without the governor causing a speed change.

A generating means generates a new position value that is a function of the actual position value and the error value, the new position value corresponding to a desired position of the throttle. The new position has a percentage of throttle opening associated therewith, e.g., 20 percent, 50 percent, 90 percent, or the like.

In one embodiment of the present invention, the electronic governor includes a means for storing a change value which corresponds to a predetermined throttle position, the predetermined throttle position having a percentage of throttle opening associated therewith. For example, the predetermined throttle position may be a throttle position corresponding to 50 to 75 percent of throttle valve opening.

The governor also includes a means for generating a pulsed control signal to the actuator having a positive pulse width which is a function of the new position value; that is, the pulse width or duty cycle of the control signal increases with the percentage of throttle valve opening corresponding to the new position value. In a first embodiment of the invention, the control signal generating means generates the control signal at a first frequency of between 60 to 70 hertz if the percentage of throttle opening associated with the new position is less than the percentage of throttle opening associated with the predetermined throttle position (cutoff value), and generates the control signal at a lower second frequency of between 5 to 30 hertz if the percentage of throttle opening associated with the new position is greater than the percentage of throttle opening associated with the predetermined position. In this way, the frequency of the pulsed control signal decreases when the percentage of throttle opening is greater than a predetermined cutoff value.

In a second embodiment of the present invention, the frequency of the pulsed control signal is decreased in a linear fashion from between about 60 to 70 hertz to between about 5 to 30 hertz as the percentage of throttle opening is increased. In the second embodiment, an associating means associates or maps a plurality of possible throttle positions with respective associated frequencies or frequency multipliers such that the frequencies are generally inversely proportional to the percentages of throttle opening corresponding to the respective possible throttle positions. The associate frequencies or frequency multipliers are stored in a look-up table. The frequencies of the pulsed control signal decrease as the percentage of throttle opening increases.

In the second embodiment, the electronic governor includes a means for determining the particular frequency or frequency multiplier associated with the new position value, and a means for generating a pulsed control signal to the actuator having a pulse width that is a function of the new position value, the control signal also having the frequency that has been associated with the new position value. The actuator then moves the throttle to the new position associated with the new position value.

In both the first and second embodiments, the speed governor is preferably a digital control system that is implemented using a control unit that calculates the actual engine speed, that determines whether the actual engine speed differs from the reference engine speed, and that outputs the pulse width and frequency modulated control signal as described above.

In another aspect, the present invention also includes a method for controlling the position of an engine throttle to change the engine speed, determining the speed of the engine, storing a reference speed corresponding to a desired engine speed, determining the actual or current position of the throttle, comparing the engine speed with the reference speed, and generating an error value if the engine speed differs from the reference speed by more than a preset value. The method also includes determining a new throttle position as a function of the actual position and the error value, the new throttle position having a first percentage of throttle opening associated therewith. A predetermined throttle position is stored, the predetermined throttle position having a second percentage of throttle opening associated therewith.

According to the method, a pulsed control signal is generated to the actuator having a pulse width that is functionally related to the throttle opening of the new position, the control signal having a first frequency if the first percentage of opening associated with the new position is less than the second percentage of throttle opening associated with the predetermined throttle position. The pulsed control signal has a second lower frequency if the first percentage of throttle opening associated with the new position is greater than the second percentage of throttle opening associated with the predetermined throttle position. In a preferred embodiment, the control signal is generated at the second frequency by multiplying the period corresponding to the first frequency by a selected multiplier. The method may include speed limiting, by preventing ignition of fuel in an engine combustion chamber for a predetermined number of engine revolutions if the engine speed exceeds the reference speed by more than the preset value.

In a second embodiment of the method, the pulsed control signal is generated at a plurality of frequencies, each of the frequencies being associated with a possible throttle position. According to this embodiment, a plurality of possible throttle positions are associated with respective frequencies such that the frequencies are generally inversely proportional to the percentages of throttle opening corresponding to the associated possible throttle positions. After the frequency associated with the new position is determined, a pulse control signal is generated to the actuator that has a pulse width that is a function of the percentage of throttle opening associated with the new position and also having a frequency that is associated with the new position. To generate the new frequencies, a base frequency may be used, and may be multiplied by a frequency multiplier value that is associated with each of the respective possible throttle positions.

It is a feature and advantage of the present invention to provide a low cost electronic speed governor which accurately controls the engine speed.

It is yet another feature and advantage of the present invention to provide a low cost electronic governor which changes the engine speed in relatively small increments to minimize undesirable changes in engine noise and to keep the speed within a preselected speed band.

These and other features and advantages of the present invention will be apparent to those skilled in the art from the following detailed description of the preferred embodiment and the drawings, in which:

DETAILED DESCRIPTION OF THE INVENTION

The present invention includes an electronic governor which allows changes in speed on the order of 10 to 15 rpm to be made at reference speeds of 3,000 or 3,600 rpm without creating undesirable, audible engine noise which would indicate that the speed's change has occurred. This is accomplished at low cost by either reducing the frequency of the actuator control signal in one or more steps as the percentage of throttle opening increases, or by reducing the frequency of the actuator control signal in a linear fashion as the percentage of throttle opening increases.

The present invention assumes that the applied load on the engine is proportional to throttle opening, and that some engine speed reduction or droop occurs when a load is applied to the engine. When a load is applied, the engine speed drops, and the electronic governor acts to increase the actual engine speed back to the reference speed by opening the throttle. Similarly, when a load is abruptly removed from the engine, the engine speed may increase and the electronic governor acts to reduce the engine speed by closing the throttle.

Figure 1:
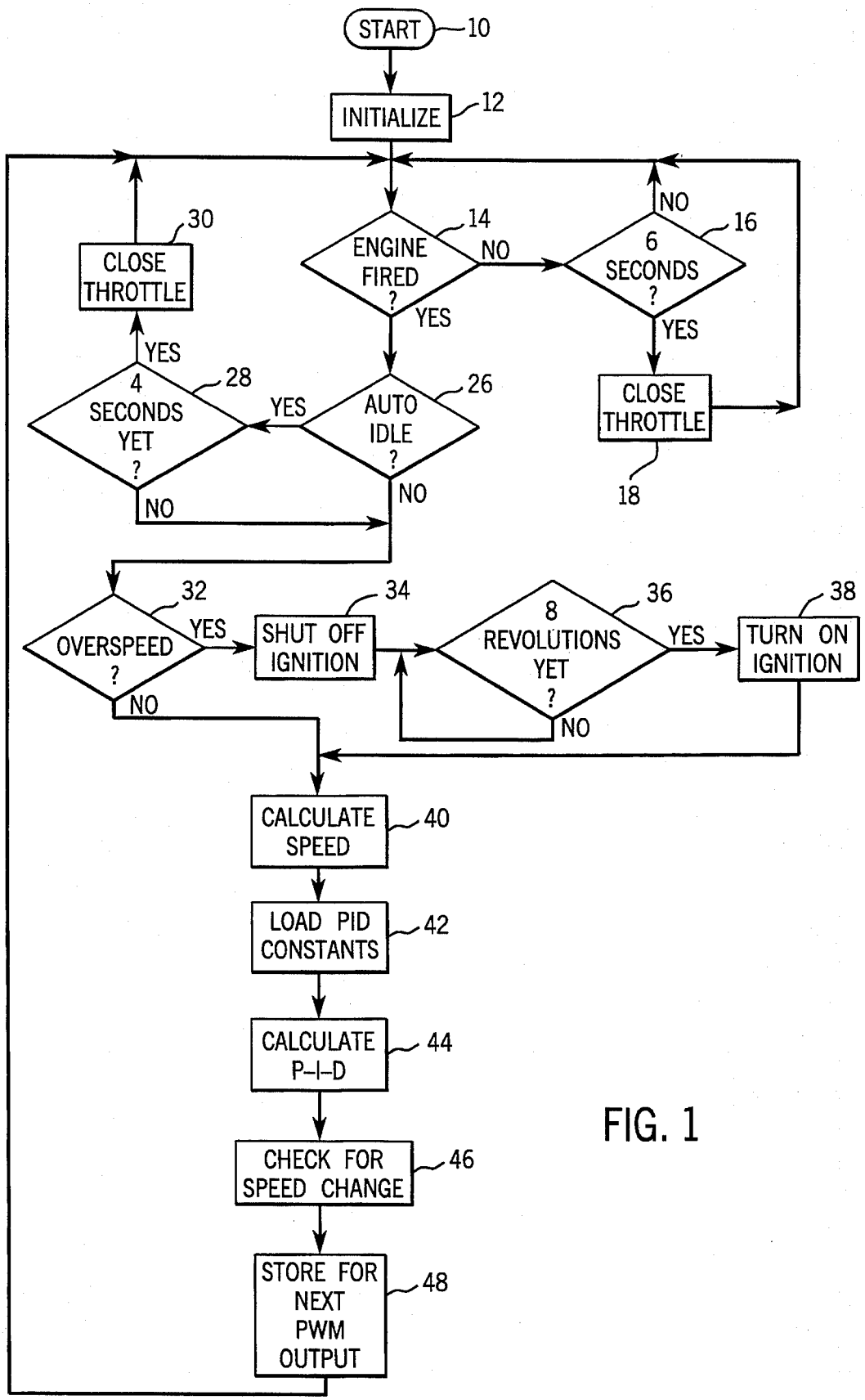
FIG. 1 is a flow diagram of the electronic governor according to the present invention.

FIG. 1 is a flow diagram of the process used to determine the time that a new actuator control pulse is generated. In FIG. 1, the program starts at step 10 and initializes the settings at step 12. At step 14 a determination is made whether the engine has fired or an ignition event has occurred. If the answer at step 14 is No, a determination is made at step 16 as to whether 6 seconds has passed. This delay assumes that a manual starter or pull rope is used.

When the pull rope is pulled, the throttle immediately goes to the wide open position. If the engine has not started, this delay allows the throttle to remain open in anticipation of another start attempt within 6 seconds to conserve the battery. If another start is not attempted within 6 seconds, the throttle is closed at step 18. The process then proceeds back to step 14.

Figure 3:
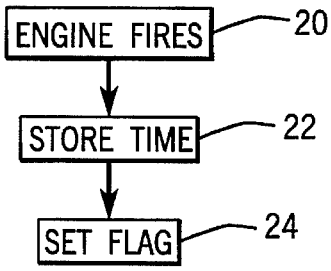
FIG. 3 is a flow diagram depicting the method in which a speed signal is sensed.

Once the engine has fired at step 14, the ignition event is sensed at step 20 (FIG. 3), and the time of the ignitioning event is stored at step 22. A flag is then set at step 24 (FIG. 3) and the process proceeds to step 26 (FIG. 1).

At step 26, a determination is made whether the engine, or a generator being powered by the engine, is set in an auto-idle mode. If the answer at step 26 is Yes, a 4-second delay is interposed at step 28 and the throttle is closed at step 30 to idle the engine down to an idle speed. This delay minimizes unnecessary speed cycling when a load is intermittently applied to the engine. If the answer at step 26 is No, then a determination is made at step 32 whether the actual engine speed exceeds the stored reference speed. If the answer at step 32 is Yes, the ignition is shut off, typically by grounding the ignition pulses, at step 34. The ignition is cut off for a pre-selected number of revolutions, which may be 8 revolutions as indicated in step 36. Once 8 revolutions have passed, the ignition is turned back on at step 38. This speed limiting technique is disclosed in U.S. Pat. No. 5,138,996 issued Aug. 18, 1992 to Fiorenza, and assigned to Briggs & Stratton the assignee of the present invention. U.S. Pat. No. 5,138,996 is incorporated by reference herein.

After the ignition is turned back on at step 38, or if an overspeed condition exists as determined at step 32, the actual engine speed is calculated at step 40. The actual engine speed is typically calculated by noting the time between two consecutive ignition events.

The present invention uses proportional-integral-differential (PID) control to correct the engine speed if the engine speed differs from the reference speed, as is well known in the art. Once the engine speed has been calculated at step 40, a stored lookup table is accessed to determine which PID constants correspond to the actual engine speed. These PID constants control the acceleration or deceleration of the engine to the reference speed so that the electronic governor does not cause the engine to overshoot the reference speed, resulting in speed oscillations or hunting. The appropriate PID constants are loaded at step 42, and the PID calculation is made at step 44.

At step 46, the system determines whether the reference speed has been changed by the operator or otherwise. Step 46 contemplates a system having two or more selectable reference speeds, which may be input using a toggle switch or a potentiometer. If a potentiometer was used, an analog to digital converter would also have to be provided in the system. If the reference speed has been changed as determined at step 26, the stored count (period) corresponding to the reference speed is increased or decreased to correspond to the count (period) of the changed reference speed.

The process as depicted in FIG. 1 is used to calculate the time at which the pulse width modulator should output a high state actuator control signal, as well as when it should output a low state actuator control signal. Once this value has been calculated, it is stored at step 48 for the next pulse of the pulse width modulated signal.

Figure 2:
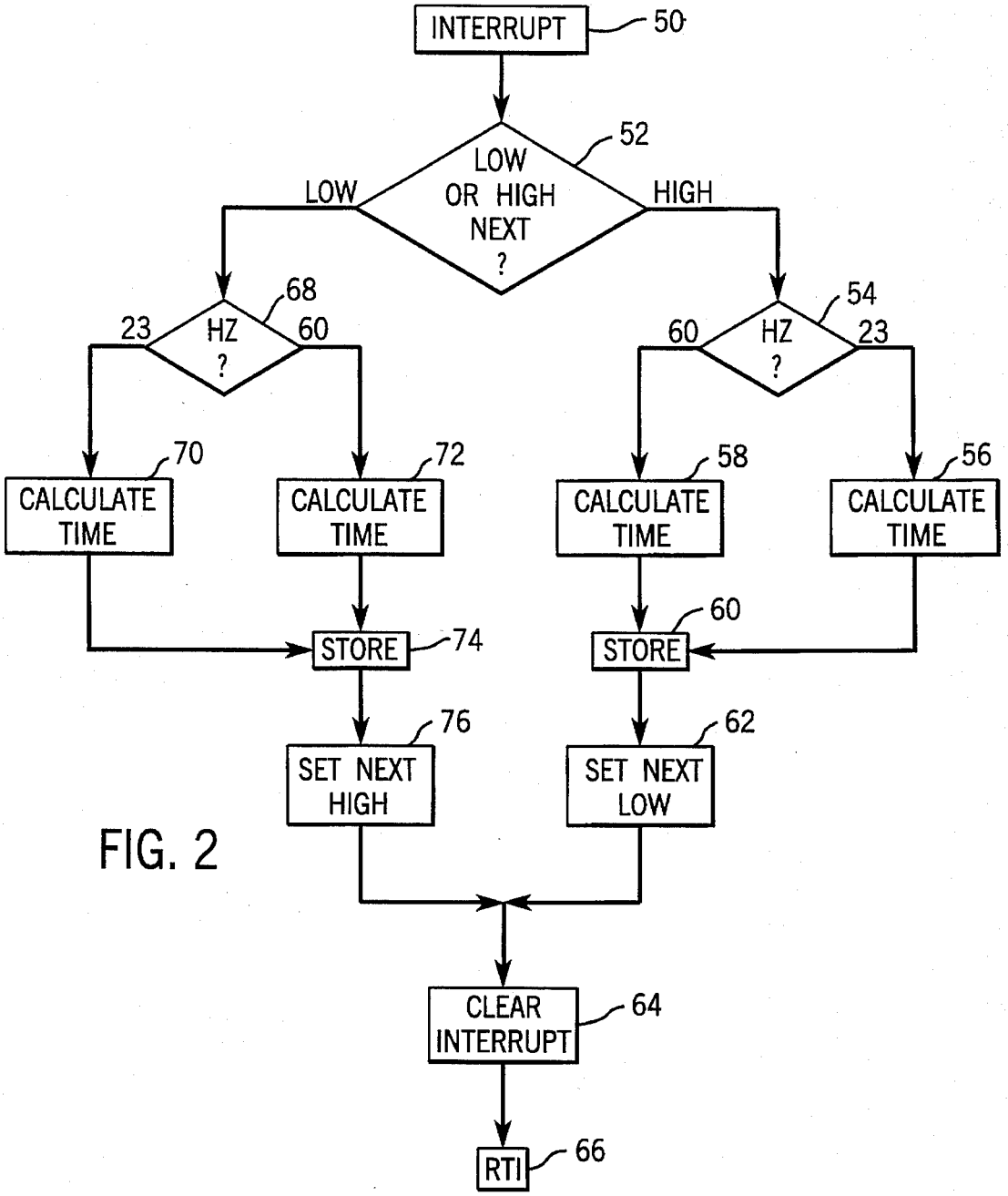
FIG. 2 is a flow diagram depicting the method in which the actuator control signal is generated.
Figure 5:
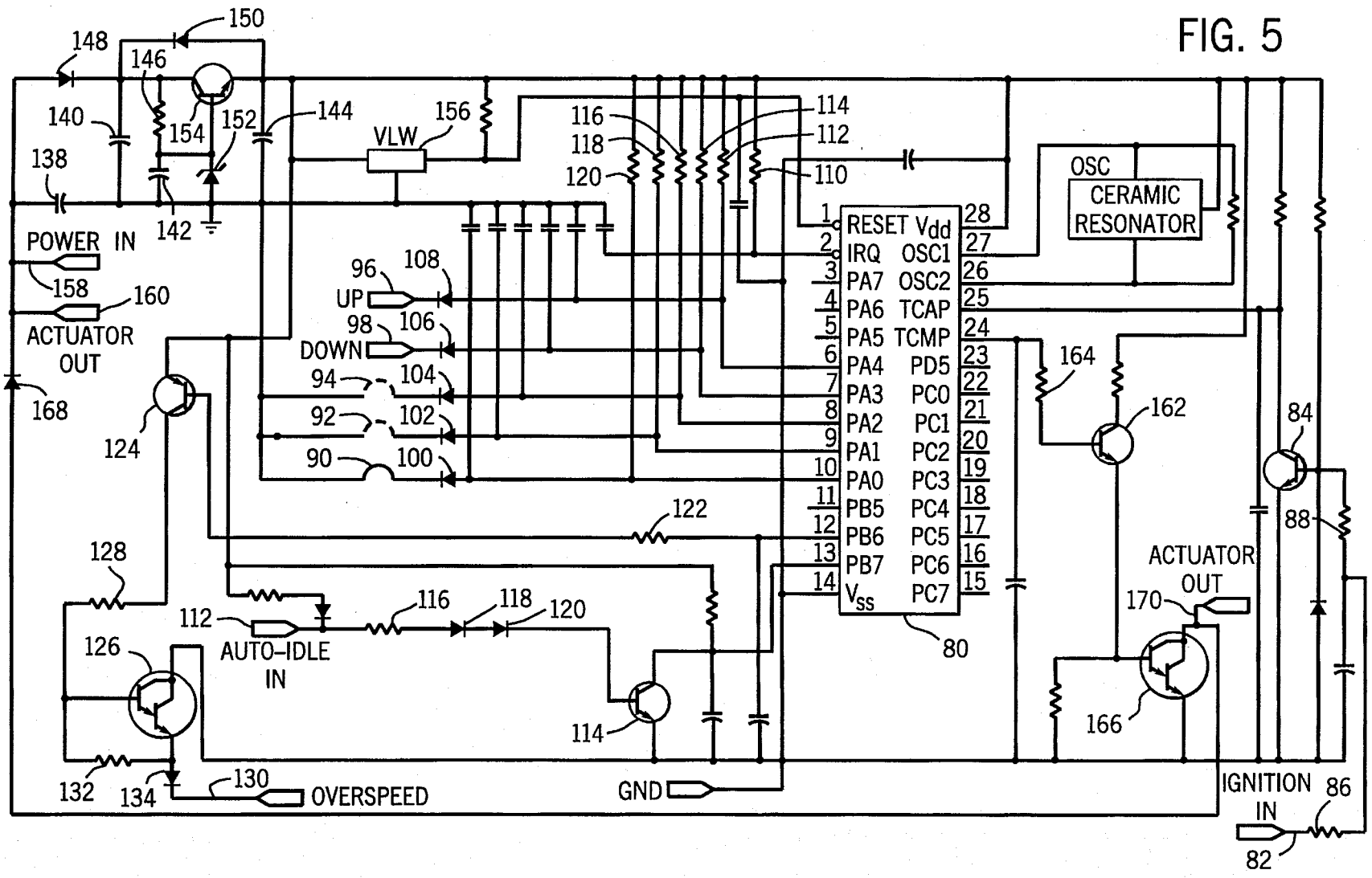
FIG. 5 is a schematic diagram of the electronic governor according to the present invention.

FIG. 2 depicts the process for generating the actuator control signal. In FIG. 2, an interrupt signal is generated at step 50 indicating that the timer was timed out for either the high or the low state of the actuator control signal which has been output by the control unit or microprocessor (FIG. 5). After the interrupt signal is generated, a determination is made at step 52 as to whether the next pulse of the actuator control signal should be a low state or a high state signal. If the next pulse is a high state signal, a determination is made at step 54 as to whether the frequency of the actuator control signal should be 60 hertz or 23 hertz. The flow chart in FIG. 2 is for a first embodiment of the invention in which only two frequencies are available for the actuator control signal, a 60 hertz signal or a 23 hertz signal.

One way of making the determination at step 54 is as follows. The percentage of throttle opening is directly proportional to the high state pulse width or duty cycle of the actuator control signal. Since the pulse width is really a function of time, the pulse ON time corresponding to the percentage of throttle opening for a new throttle position may be compared with a change or cutoff value that corresponds to a predetermined throttle position. If the duty cycle time is greater than the time (duty cycle pulse width) corresponding to the percentage of throttle opening for the cutoff value, the actuator control frequency is set to the lower frequency, namely 23 hertz in the present example. The 23 hertz frequency may be obtained by multiplying the period corresponding to the 60 hertz signal by a multiplier value to yield the period corresponding to the 23 hertz signal.

On the other hand, if the duty cycle time is less than the time associated with the cutoff value, the actuator control signal frequency is set to the higher frequency.

The duration of the high state pulse width for the new position, used in the determination at step 54, is obtained by determining the duration of the pulse width corresponding to the present throttle opening, and adding to it a value corresponding to the error between the reference speed and the actual engine speed. The new time will correspond to the duration of the duty cycle pulse of the new position to which the electronic governor is to move the throttle so that the actual engine speed becomes substantially equal to the reference speed.

After step 54, the time corresponding to the pulse width associated with the new position is calculated at either step 56 or step 58, and is stored at step 60. At step 62, a flag is set indicating that the next pulse of the actuator control signal will be a low state signal. The interrupt is cleared at step 64, and at step 66 the routine returns to step 50.

Again referring to FIG. 2, if the low state signal is the next signal as determined at step 52, the routine proceeds to step 68. At step 68, a determination is made as to whether the frequency of the actuator control signal is a relatively low frequency of 23 hertz, or a higher frequency of 60 hertz. The frequency of the control signal determines the OFF or low state time of the actuator control signal. At a lower frequency, the OFF time of the control signal is substantially increased, thereby allowing the magnetic field in the actuator to completely dissipate. As a result, true "dithering" of the throttle is allowed to occur; that is, the throttle begins to move in the closed direction as the result of the return spring and the biased (off-center) nature of the throttle, until the next ON time of the actuator control signal is received.

The determination at step 68 is similar to the determination made at step 54. The appropriate time for the low state pulse is then determined at either step 70 or 72, this time being stored at step 74. At step 76, the flag is set to indicate that the next pulse will be a high state pulse. The interrupt is cleared at step 64, and at step 66 the routine returns to interrupt step 50.

In the embodiment depicted and described in connection with FIG. 2 above, the predetermined throttle position or cutoff value corresponds to a 73 percent throttle opening. However, other predetermined throttle positions could be used, corresponding to between 50 to about 75 percent of throttle opening. Of course, it may be advantageous to have one or more additional frequency change steps at different cutoff values corresponding to different percentages of throttle opening.

In a second embodiment of the present invention, the frequency of the actuator control signal may decrease continuously, so that the frequency is generally inversely proportional to the percentage of throttle opening. For example, the actuator control signal would have a frequency of about 60 to 70 hertz when the throttle is about zero to 10 percent open, with the actuator control signal decreasing in a linear fashion to about 5 to 30 hertz when the throttle is 90 to 100 percent open.

In the second embodiment, each of the possible throttle positions would be associated or mapped with a specific frequency or frequency multiplier and stored in a lookup table. Each of the possible throttle positions may be associated with a hexadecimal value between zero and FFFF at wide open throttle. The hexadecimal value would actually correspond to a floating average of the throttle opening, which in turn is proportional to the applied load and to the percentage of throttle opening.

Once the governor has determined that the actual engine speed differs from the reference speed by more than the preset value, the governor calculates the number corresponding to the new throttle position. Each throttle position has associated therewith a percentage of throttle opening. Once the value corresponding to the new position has been determined, a frequency multiplier is accessed from the lookup table, and is multiplied by a fundamental frequency to achieve the new frequency. The actuator control signal is then output at the new frequency.

Figure 4:
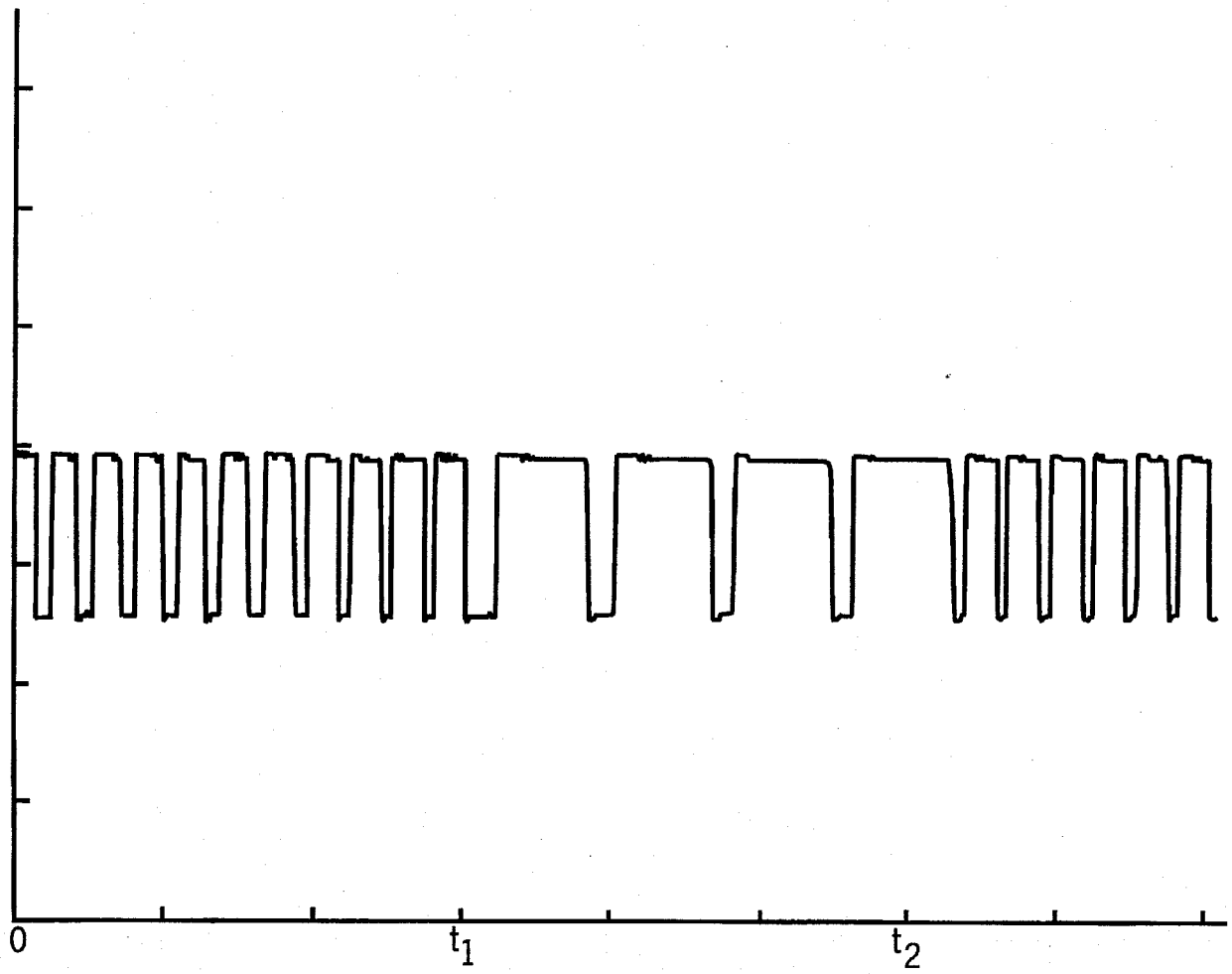
FIG. 4 is a timing diagram depicting a typical pulsed actuator control signal being generated at a first frequency, then at a second lower frequency, and subsequently at the first frequency again.

FIG. 4 depicts a typical actuator control signal that may be generated by the first embodiment of the present invention. In FIG. 4, the actuator control signal has a frequency of 60 hertz beginning at time T0 and continuing until a substantial load is applied to the engine at time T1. At that point, the engine speed droops, and the governor increases the engine speed by opening the engine throttle to a position which has a percentage opening greater than that of the cutoff or predetermined value. The ON time pulse width of the actuator control signal is substantially increased, and the frequency of the actuator control signal is decreased to 23 hertz. The frequency of the control signal stays at 23 hertz until the load is removed from the engine at time T2, when the frequency is reset to 60 hertz.

FIG. 5 is a schematic diagram of a microprocessor-based electronic governor according to the present invention.

In FIG. 5, control unit 10 is a microprocessor from the 6805 family of microprocessors, specifically a Motorola HC705 microprocessor. Microprocessor 80 senses an ignition event on its pin 25 when an ignition signal on line 82 gates ON a transistor 84 through resistors 86 and 88. When transistor 84 is turned ON, pin 25 of control unit 80 goes to a high state, indicating that the ignition event has occurred. The ignition event corresponds to the time at which an ignition signal or spark is provided to a combustion chamber of the engine.

The selected reference speed for the engine is input on pin 10 of control unit 80. If the reference speed is set at 3,600 rpm, loop 90 remains connected. If the reference speed is to be set at another value such as 3,000 rpm, loop 90 is clipped. When the loop is clipped, control unit 80 retrieves a time value out of its memory corresponding to a 3,000 rpm setting. When the loop is not clipped, control unit 80 retrieves a time value from its memory corresponding to a 3,600 rpm setting. Loops 92 and 94, with their respective control unit pins 8 and 9, are optional inputs that may be used to set additional reference speeds in particular applications.

Up line 96 and Down line 98 are connected to a toggle switch that may be used to change the reference speed setting. The toggle switch has three settings: an UP position for increasing the reference speed, a DOWN position for decreasing the reference speed, and a neutral or run position. When the toggle switch is in the UP position, a signal is generated on line 96 which instructs control unit 80 to increase the reference speed by an amount proportional to the length of time that the toggle switch is in the UP position. Conversely, when the toggle switch is in the DOWN position, a signal is present on line 98 which instructs control unit 80 to decrease the selected reference speed by a speed proportional to the amount of time that the toggle switch is in the DOWN position. The toggle switch allows the reference speed to be selected at any speed between 1,200 and 3,600 rpm. Diodes 100, 102, 104, 106 and 108 protect pins 10 through 6 respectively from voltage spikes. Resistors 110 through 120 are pull-up resistors for pins 2, 6, 7, 8, 9 and 10 respectively of control unit 80.

As discussed above in connection with FIG. 1, the engine may have an auto-idle feature. If the auto-idle feature is engaged, a signal is present on line 112, which gates ON a transistor 114 through resistor 116 and diodes 118 and 120, thereby bringing pin 13 of control unit 80 to a low state. Four seconds later, the control unit idles down the engine to an idle speed. The four second delay is used to prevent unnecessary speed cycling, which may otherwise occur if the load is intermittently being applied to the engine. This intermittent application may occur, for example, if the engine is being used to power a generator, which in turn is powering a rotary saw or power drill that is intermittently used.

The present invention also includes a means for grounding engine ignition pulses for a preselected number of engine revolutions if the actual engine speed exceeds the reference speed. In that event, control unit 80 outputs a voltage signal on its pin 12 through a resistor 122 to gate ON a transistor 124. As a result, transistor 126 is gated ON through resistor 128, causing a signal to appear on overspeed line 130 through a resistor 132 and a diode 134. The signal on line 130 causes ignition pulses to be short circuited to ground through a switch (not shown). After a preselected number of engine revolutions, the signal at pin 12 of control unit 80 is removed, and ignition resumes.

Power to the circuit is supplied through a power line 136 and a voltage regulator, consisting of capacitors 138, 140, 142 and 144, resistor 146, diodes 148 and 150, zener diode 152 and transistor 154.

Device 156 is a voltage monitor which monitors the battery voltage, and which outputs a reset signal to pin 1 of microprocessor 80 in the event that the battery voltage drops below 4.6 volts.

The pulse width modulated actuator control signal is output on pin 24 of microprocessor 80. As shown in FIG. 5, the actuator coil is supplied with a 12 volt signal from line 158 through line 160. This voltage signal is switched by the actuator control signal on pin 24 of microprocessor 80. The actuator control signal controls a transistor 162 through a resistor 164. Resistor 162 in turn gates a Darlington transistor 166. When Darlington 166 is gated ON, the 12 volt signal passes from line 160 through diode 168 and through the other end of the actuator coil designated by line 170. The pulse width and frequency of the actuator control signal are determined as discussed above in connection with FIGS. 1 through 3. The actuator is preferably a 12 VDC actuator having 500 turns of 24 gauge wire, such as a Briggs part number 495169 available from Briggs & Stratton, and manufactured by Jakel, Inc. of Highland, Ill.

While several embodiments of the present invention have been shown and described, alternate embodiments will be apparent to those skilled in the art and are within the intended scope of the present invention. Specifically, the invention could be implemented with discrete components using timer integrated circuits as opposed to a microprocessor, or could be implemented in firmware as opposed to using a programmable microprocessor. Therefore, the scope of the invention is to be limited only by the following claims.

I claim:

1. A speed governor that controls the opening and the closing of an engine throttle to change the engine speed, comprising:

an actuator that is interconnected with said throttle;

means for determining the speed of said engine, and for storing an engine speed value representative of said engine speed;

means for storing a reference speed value functionally related to a reference speed;

means for storing an actual position value functionally related to the actual position of said throttle;

means for comparing said engine speed value with said reference value, and for generating an error value if said engine speed value differs from said reference speed value by more than a preset value;

means for generating a new position value that is a function of said actual position value and said error value, said new position value corresponding to a new position of said throttle, said new position having a percentage of throttle opening associated therewith;

means for storing a change value corresponding to a predetermined throttle position, said predetermined throttle position having a percentage of throttle opening associated therewith; and means for generating a pulsed control signal to said actuator having a pulse width that is a function of said new position value, said control signal generating means generating said control signal at a first frequency if the percentage of throttle opening associated with said new position is less than the percentage of throttle opening associated with said predetermined throttle position, and generating said control signal at a second frequency if the percentage of throttle opening associated with said new position is greater than the percentage of throttle opening associated with said predetermined throttle position.

2. The speed governor of claim 1, wherein said first frequency is greater than said second frequency.

3. The speed governor of claim 2, wherein said first frequency is between 60 to 70 hertz, and wherein said second frequency is between 5 to 30 hertz.

4. The speed governor of claim 1, wherein said comparing means and said control signal generating means includes a programmed microprocessor.

5. A speed governor that opens and closes an engine throttle to change the engine speed, comprising:

an actuator that is interconnected with said throttle;

means for determining the engine speed, and for storing an engine speed value representative of said engine speed;

means for storing a reference value functionally related to a reference speed;

means for storing an actual position value functionally related to the actual position of said throttle;

means for comparing said engine speed value with said reference value, and for generating an error value if said engine speed value differs from said reference speed value by more than a preset value;

means for generating a new position value that is a function of said actual position value and said error value, said new position value corresponding to a new position of said throttle;

means for associating a plurality of possible throttle positions with respective associated frequencies such that said frequencies are generally inversely proportional to the percentages of throttle opening corresponding to the respective possible throttle positions;

means for determining the frequency associated with said new position value; and means for generating a pulsed control signal to said actuator having a pulse width that is a function of said new position value, said control signal also having the frequency associated with said new position value;

whereby said actuator moves said throttle to the new position associated with said new position value.

6. The apparatus of claim 5, wherein said control signal frequency decreases from between 60 to 70 hertz when the new position corresponds to nearly zero percent of throttle opening, to between 5 to 30 hertz when the new position corresponds to nearly 100 percent of throttle opening.

7. The speed governor of claim 5, wherein said comparison means includes a microprocessor.

8. A digital speed control system that changes the position of an engine throttle, comprising:

an actuator that is interconnected with said throttle;

sensor means for sensing a plurality of engine events;

a control unit that calculates the actual engine speed based upon said plurality of sensed engine events, that determines whether said actual engine speed differs from a reference engine speed, and that outputs a pulse width modulated, frequency modulated control signal to said actuator to change the current throttle position to a new position if the actual engine speed differs from the reference speed, said control unit including means for determining the pulse width of said control signal as a function of the new position, and the control unit including means for determining the frequency of said control signal as a function of the new position.

9. The speed control system of claim 8, wherein the throttle position is changed only if the actual engine speed differs from the reference speed by at least a preset value.

10. The speed control system of claim 8, wherein said pulse width determining means includes means for generating a pulse width that is directly proportional to a percentage of throttle opening associated with said new position.

11. The speed control system of claim 8, wherein said frequency determining means includes means for generating a control signal having a frequency that is inversely proportional to a percentage of throttle opening associated with said new position.

12. The speed control system of claim 11, wherein said frequency is between 60 to 70 hertz when the percentage of throttle opening associated with the new position is near zero, and is between 5 to 30 hertz when the percentage of throttle opening associated with the new position is near 100 percent.

13. The speed control system of claim 8, wherein said frequency determining means sets said control signal frequency to a first frequency when the percentage of throttle opening associated with said new position is less than a predetermined value, and wherein said frequency determining means sets said control signal frequency to a second lower frequency when the percentage of throttle opening associated with said new position is greater than said predetermined value.

14. The speed control system of claim 13, wherein said first frequency is between 60 to 70 hertz, and wherein said second frequency is between 5 to 30 hertz.

15. A method of controlling the position of an engine throttle to change the engine speed, comprising:

determining the speed of said engine;

storing a reference speed corresponding to a desired engine speed;

determining the actual position of said throttle;

comparing said engine speed with said reference speed, and generating an error value if the engine speed differs from said reference speed by more than a preset value;

determining a new throttle position as a function of said actual position and said error value, said new throttle position having a first percentage of throttle opening associated therewith;

storing a predetermined throttle position, said predetermined throttle position having a second percentage of throttle opening associated therewith; and generating a pulsed control signal to said actuator having a pulse width that is functionally related to said new position, said control signal having a first frequency if said first percentage of throttle opening associated with said new position is less than said second percentage of throttle opening associated with said predetermined throttle position, and said control signal having a second lower frequency if said first percentage of throttle opening associated with said new position is greater than said second percentage of throttle opening associated with said predetermined throttle position.

16. The method of claim 15, wherein said control signal generating step includes:

multiplying the period corresponding to said first frequency by a multiplier to generate said control signal at said second frequency.

17. The method of claim 15, further comprising:

preventing ignition of fuel in an engine combustion chamber for a predetermined number of engine revolutions if the engine speed exceeds said reference speed by more than said preset value.

18. A method of opening and closing an engine throttle to change the engine speed, comprising:

determining the speed of said engine;

storing a reference speed corresponding to a desired engine speed;

determining the actual position of said throttle;

comparing said engine speed with said reference speed, and generating an error value if the engine speed differs from said reference speed by more than a preset value;

determining a new throttle position as a function of said actual position and said error value, said new throttle position having a first percentage of throttle opening associated therewith;

associating a plurality of possible throttle positions with respective associated frequencies such that said frequencies are generally inversely proportional to the percentages of throttle opening corresponding to the respective possible throttle positions;

determining the frequency associated with the new position; and generating a pulsed control signal to said actuator having a pulse width that is a function of the percentage of throttle opening associated with said new position, and also having the frequency associated with said new position.

19. The method of claim 18, further comprising:

preventing ignition of fuel in an engine combustion chamber for a predetermined number of engine revolutions if the engine speed exceeds said reference speed by more than said preset value.

20. The method of claim 18, wherein said associating step includes:

associating a frequency multiplier value with each of said possible throttle positions;

and wherein said frequency determining step includes multiplying a known frequency by the multiplier value associated with said new position.

* * * * *